US008579653B2

(12) United States Patent
Neumann-Henneberg

(10) Patent No.: US 8,579,653 B2
(45) Date of Patent: Nov. 12, 2013

(54) ELECTRICAL PLUG CONNECTOR HAVING A CONTACT ELEMENT WITH INWARDLY AND OUTWARDLY PROTRUDING KNOBS

(76) Inventor: Wolf Neumann-Henneberg, Rietheim-Weilheim (DE)

( * ) Notice: Subject to any disclaimer, the term of this patent is extended or adjusted under 35 U.S.C. 154(b) by 23 days.

(21) Appl. No.: 13/539,811

(22) Filed: Jul. 2, 2012

(65) Prior Publication Data

US 2013/0171886 A1 Jul. 4, 2013

(30) Foreign Application Priority Data

Nov. 21, 2011 (EP) ..... 11401637

(51) Int. Cl.
*H01R 13/58* (2006.01)

(52) U.S. Cl.
USPC ..... 439/469

(58) Field of Classification Search
USPC ..... 439/469, 676, 395, 314–319
See application file for complete search history.

(56) References Cited

U.S. PATENT DOCUMENTS

| | | | | |
|---|---|---|---|---|
| 5,769,671 | A | 6/1998 | Lim | |
| 5,993,129 | A * | 11/1999 | Sato | 411/80.6 |
| 6,094,122 | A | 7/2000 | Sexton | |
| 6,379,197 | B2 * | 4/2002 | Matsuda et al. | 439/801 |
| 6,877,277 | B2 * | 4/2005 | Kussel et al. | 49/314 |
| 7,097,491 | B2 * | 8/2006 | Neumann-Henneberg | 439/395 |
| 7,299,095 | B1 | 11/2007 | Barlow et al. | |
| 8,202,495 | B1 * | 6/2012 | Smith | 422/524 |
| 2006/0040545 | A1 * | 2/2006 | Neumann-Henneberg | 439/469 |
| 2011/0281450 | A1 | 11/2011 | Loke et al. | |

FOREIGN PATENT DOCUMENTS

| | | |
|---|---|---|
| DE | 623 128 | 12/1935 |

* cited by examiner

*Primary Examiner* — Chandrika Prasad
(74) *Attorney, Agent, or Firm* — Von Rohrscheldt Patents

(57) ABSTRACT

The invention relates to an electrical plug connector including a pin-shaped plug and a sleeve-shaped coupling which encloses the plug with an intermediary cavity and open washer shaped spring elastic contact elements which are arranged in the cavity. In order to provide a good electrical contact the invention proposes two inward protruding knobs of the contact elements, wherein the knobs are arranged opposite to one another. Outward protruding knobs limit a maximum deformation of the contact elements and thus prevent a mechanical overload of the contact elements.

9 Claims, 2 Drawing Sheets

ELECTRICAL PLUG CONNECTOR HAVING A CONTACT ELEMENT WITH INWARDLY AND OUTWARDLY PROTRUDING KNOBS

RELATED APPLICATIONS

This application claims priority from European patent application EP 11 401 637.1 filed on Nov. 21, 2011 which is incorporated in its entirety by this reference.

FIELD OF THE INVENTION

The invention relates to an electrical plug connector with the features of the preamble of patent claim 1. The invention is in particular suitable for disengageable electrical connections for voltages above 1000 Volts and currents of a few hundred Amperes. The plug connector is also useable instead of cable shoes or threaded connections.

BACKGROUND OF THE INVENTION

The patent document DE 623 128 discloses an electrical plug connector with a pin shaped plug and a sleeve shaped coupling which encloses the plug with an annular intermediary cavity in inserted condition, this means when the plug is inserted into the coupling. A stack of flat or disc shaped contact elements is arranged in the intermediary cavity which contact elements are made from electrically conductive material, in particular metal. In one embodiment the contact elements are washers stamped from sheet metal with an inner circular ring in their center and two circular arc shaped spring arms which enclose the circular ring at a radial distance. The first ends of the spring arms are free at the second ends the spring arms integrally transition into the inner circular ring. The spring arms contact the inside of the sleeve shaped coupling and load the inner circular ring in radial direction in a spring elastic manner, so that the circular ring is arranged in the coupling in an eccentrial manner. The contact elements that are arranged in the sleeve shaped coupling in a stacked manner are arranged rotated relative to one another by 180° in an alternating manner, so that their inner rings are arranged in an alternating opposite eccentrical manner in the coupling. The plug which has a slightly smaller diameter than the rings of the contact elements centers the inner rings of the contact elements so that the inner rings contact the plug in a spring elastic manner. This way the spring arms of the washer shaped contact elements of the known electrical plug connector generate a contact pressure at the sleeve shaped coupling and also at the pin shaped plug, wherein the contact pressure provides a reliable electrically conductive connection of the plug with the coupling through the contact elements.

In a second embodiment the contact elements of the known electrical plug connector are bent from wire material. They include an open inner ring, this means an inner ring that is interrupted at one location and which is bent at sides of the opening of the ring by 180° towards the outside to form circular arc shaped spring arms which enclose the interrupted inner ring at a radial distance on the outside.

BRIEF SUMMARY OF THE INVENTION

Thus, it is an object of the invention to provide an electrical plug connector as provided supra whose contact elements are better protected against mechanical overload.

This object is achieved through the features of claim 1. The electrical plug connector according to the invention includes a pin shaped plug and a sleeve shaped coupling which encloses the plug with an intermediary cavity in inserted condition, thus when the plug is inserted into the coupling. In this intermediary cavity an electrically conductive contact is arranged which has the shape of an open ring, this means a ring that is interrupted at one location. In circumferential direction the contact element extends over more than 180°, in particular it extends over almost the entire circumference and only has a small opening. The contact element is spring elastic transversal to an insertion direction of the plug into the coupling which means that the coupling is inserted onto the plug. In inserted condition the contact element contacts the plug on an inside and also contacts an outside of the coupling in a spring elastic and thus preloaded manner and thus connects the plug and the coupling with one another in an electrically conductive manner.

The contact element according to the invention includes protrusions that are oriented inward and outward, wherein the protrusions extend in inward and outward direction beyond an enveloping line. In inserted condition the inward extending protrusions contact the plug. Due to the preload of the spring elastic contact element the inward oriented protrusions contact the plug with a preload. This way the invention reaches a well conducting electrical connection between the plug and the contact element with a low electrical resistance.

The protrusions extending outward from the contact element do not contact the sleeve, but there is a gap between the outward extending protrusions of the contact element and the coupling, thus also when the plug is inserted into the coupling. In the sleeve shaped coupling the contact element contacts at another location besides the outward extending protrusions in order to connect the contact element with the coupling in an electrically conductive manner. The outward extending protrusions secure the contact element against a mechanical overload. The outward extending protrusions limit a deformation of the spring elastic contact element in outward direction and prevent this way a plastic deformation and a fracture under load cycles. The contact element is mechanically loaded through vibrations, for example during driving operations or through alignment errors of the plug in the coupling, this means a radial and/or angular offset.

Preferably the plug and the coupling have a circular cross section and the contact element has the shape of an interrupted circular ring. The circular cross section of the plug and or the coupling applies for a plug in portion, this means the portion in which the contact element is arranged in the inserted condition. For the coupling the circular cross section relates to an inner circumference. On the outside the coupling does not have to be circular. Other cross sectional shapes and annular shapes, for example a round but not circular, for example an elliptical or oval cross section or a polygonal cross section or a cross section with arcuate sections and straight sections, however are not provided but are not excluded either.

In an advantageous embodiment of the invention the plug connector includes plural contact elements that are arranged as stacks. The contact elements are arranged contacting one another in plug in direction of the plug and behind one another in the plug. Also an arrangement of the contact elements with an offset from one another is conceivable. The contact elements can be arranged in identical rotational positions or rotated relative to one another. Plural contact elements increase a maximum permissible current through the plug connector and reduce an electrical resistance between the plug and the coupling.

One embodiment of the invention provides transversal supports of the plug in the coupling on both sides of the contact element. In inserted condition the plug is supported between an outlet and the contact element and between a free end of the plug and the contact element in transversal direction in the coupling. The transversal supports can be configured as sockets. The transversal supports support the plug in a predetermined aligned position in the coupling. The transversal supports prevent relative movements between the pug and the coupling transversal to the insertion direction and thus counteract a radial and angular offset of the plug in the coupling. Also this measure is used for securing the contact element against mechanical overload and is configured to improve the electrical connection between the plug and the coupling by providing the predetermined position of the plug in the coupling as stated supra.

An embodiment of the invention provides that the inward extending protrusions are arranged offset from a center plane of the annular contact element. The protrusions are offset to the same side of the center plane, preferably in a direction towards the open location of the annular contact element. Due to the spring elastic contact of the contact element at the plug the protrusions that are offset from the center plane and extend in inward direction generate a radial force which loads the contact element in a transversal direction. The contact element is thus pressed into a predetermined position on the plug and in the coupling.

The outward extending protrusions in one embodiment of the invention are arranged opposite to the inward extending protrusion in order to support the contact element at locations against mechanical overload in the sleeve shaped coupling at which locations the plug imparts a force onto the contact element.

Preferably the contact element includes two outer and two inner protrusions.

As a matter of principle the contact element can be arranged on the plug. The contact element is advantageously arranged in the coupling, wherein the arrangement of the contact element on the plug or in the coupling relates to an unplugged condition because in plugged in condition the contact element is arranged on the plug and also in the coupling.

BRIEF DESCRIPTION OF THE DRAWINGS

The invention is now described in more detail based on an embodiment with reference to drawing figures, wherein.

Figure 1:
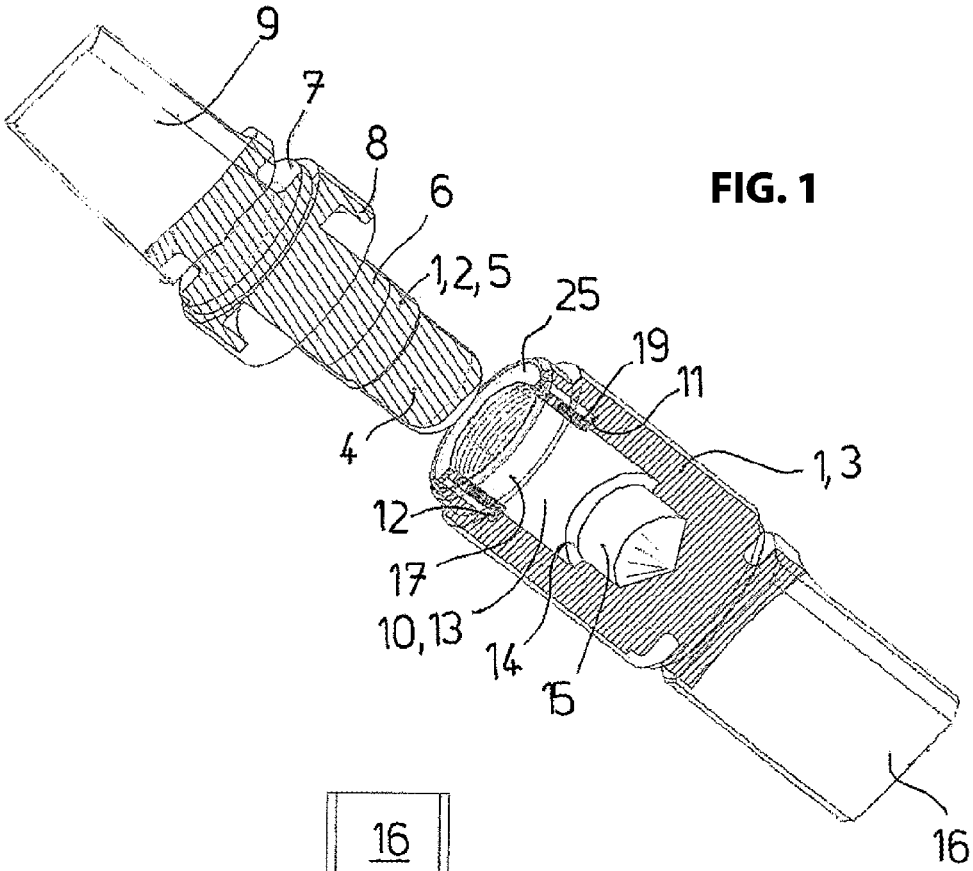
FIG. 1 illustrates an axial sectional view of a plug connector according to the invention in a perspective view, wherein edges are drawn that are arranged in front of a section plane.

The figures are drawn in different scales.

DETAILED DESCRIPTION OF THE INVENTION

The electrical plug connector 1 according to the invention that is illustrated in the drawing figure includes a cylindrical pin shaped plug 2 and a sleeve shaped cylindrical coupling 3. The plug 2 at a free front end includes a cylindrical support section 4 connected thereto, a frustum shaped spreading section 5 and connected thereto a cylindrical contact section 6. At the end of the contact section 6 the pug 2 includes a radial flange 7 from which a hollow cylindrical collar 8 extends towards the free end of the plug 2. The collar 8 encloses the contact section 6 with a radial circular intermediary cavity. The collar 8 is lower in axial direction than the length of the contact section 6. At the flange 7 a cable connection 9 is connected for connecting the plug 2 with a cable that is not illustrated or another electrical conductor. The cable can be connected in a known manner through welding, crimping, swedging, screw clamps at the plug 2. The configuration of the cable connection 9 is not essential for the invention.

The sleeve shaped coupling 3 includes a cylindrical receiver cavity 10 with diameters configured in steps for the plug 2. Adjacent to the opening the receiver cavity 10 of the coupling 3 includes a contact section 11 which tapers with a circular support stage 12 to a cylindrical intermediary section 13 which in turn tapers with an annular step 14 to a cylindrical support section 15 at an end of the receiver cavity 10 configured as a dead hole. At an end oriented away from the opening the coupling 3 includes a cable connection 16 for connecting with a non illustrated cable or another electrical conductor like the plug 2. The configuration of the cable connection 16 is not relevant for the invention.

At the opening the coupling 3 tapers on the outside with an annular shoulder to form a cylindrical collar 17 whose outer diameter coincides with an inner diameter of the collar 8 of the plug 2. A diameter of the support section 4 of the plug 2 coincides with an inner diameter of the support section 15 of the receiver cavity 10 of the coupling 3. In inserted condition, this means when the plug 2 is inserted into the coupling 3, which means the same as inserting the coupling 3 onto the plug 2, the support section 4 of the plug 2 is in the support section 15 of the coupling 3 and the collar 17 of the coupling 3 is in the collar 8 of the plug 2. The two collars 8, 17 and also the two support sections 4, 15 fit into one another so that the plug 2 is aligned in a coaxial manner in the coupling 3. The support sections 4 of the plug 2 and 15 of the coupling 3 form a transversal support as well as the collar 17 of the coupling 3 and the collar 8 of the plug 2 which support the plug 2 transversally or radially in the coupling 3 when the plug is inserted in to the coupling 3, this means the support sections align the plug 2 and the coupling 3 coaxial to one another and keep it in alignment to one another. An alignment error, thus a transversal or radial offset and an angular offset of the plug 2 relative to the coupling 3 is prevented by the transversal supports 4, 15; 8, 17.

The intermediary section 13 of the receiver cavity 10 of the coupling 3 has a slightly larger diameter than the contact section 6 of the plug 2. No contact of the contact section 6 of the plug 2 with the intermediary section 13 of the receiver cavity 10 of the coupling 3 is provided, wherein the plug in inserted condition penetrates the intermediary section 13. On the other hand side a contact of this type is not detrimental.

Figure 3:
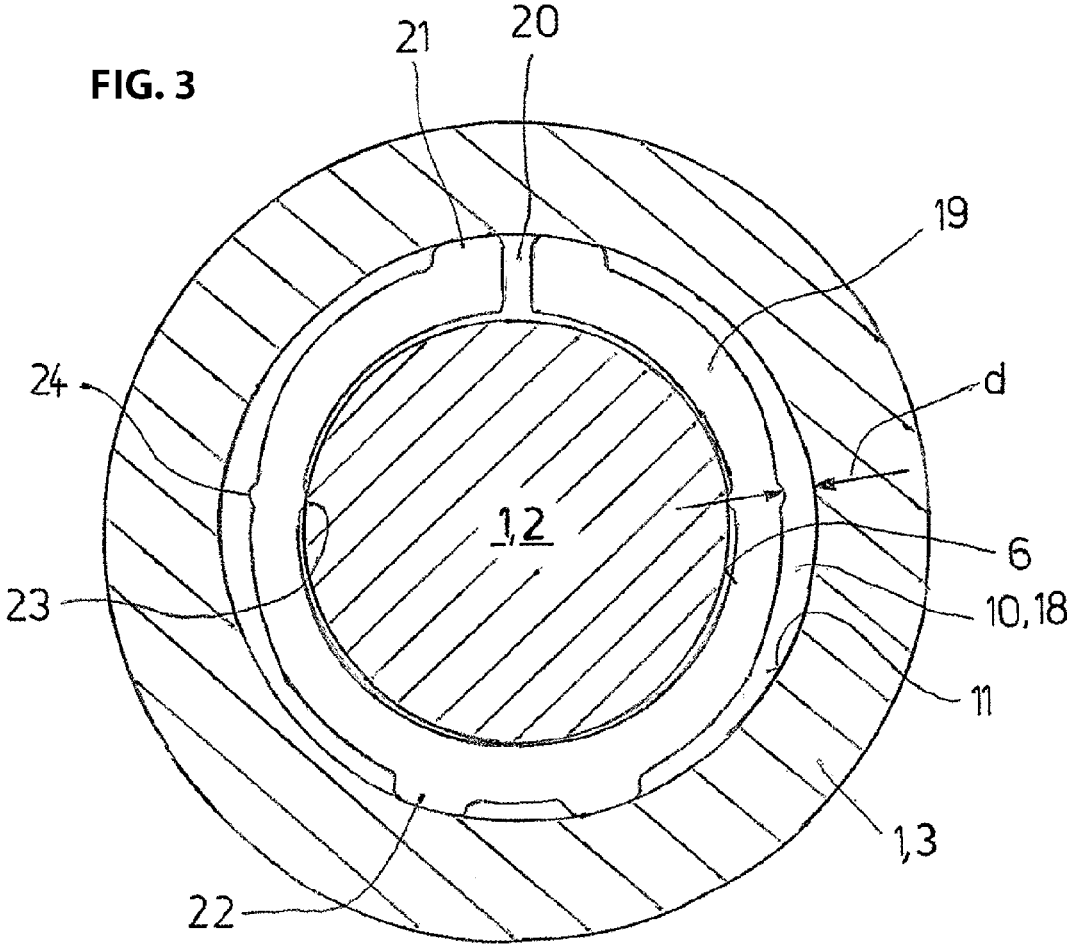
FIG. 3 illustrates a cross section of the plug connector according to FIG. 1 in inserted condition.

The contact section 11 of the receiver cavity 10 of the coupling 3 has a larger diameter than the contact section 6 of the plug 2 so that an annular intermediary cavity 18 between the coupling 3 and the plug 2 is provided when the plug 2 is inserted into the coupling 3. In the contact section 11 in the receiver cavity 10 of the coupling 3, there is a stack, this means a stack of electrically conductive contact elements 19 arranged axially behind one another. The contact elements 19 can also be considered as lamellas. One of the contact elements 19 is illustrated in FIG. 3. The contact elements 19 are flat annular washers stamped from sheet metal, they are substantially circular but not exactly circular in the embodiment. The contact elements 19 include an opening 20 at one location of its circumference. This means they are shaped as interrupted rings. On both sides of the opening 20, the contact elements 19 include outward extending protrusions 21. The contact elements 19 include similar protrusions 22 opposite to the opening 20. The contact elements 19 are elastic. This means the contact elements elastically flex into the coupling 3 in radial direction, this means transversal to the plug-in direction of the plug 2. In the contact section 11 of the receiver cavity 10 of the coupling 3 which contact section supports the contact elements 19 like a socket, the contact elements 19 are elastically compressed in a radial direction so that their protrusions 21, 22 resiliently contact an inside of the contact section 11 of the receiver cavity 10 of the coupling 3 with a preload. This provides an electrically well conductive connection between the coupling 3 and the contact elements 19 with low electrical resistance.

At their insides, the contact elements 19 include two inward extending protrusions which are designated herein as knobs 23 which are arranged approximately in a center between the outward extending protrusions 21 at the opening 20 and the opposite outward extending protrusions 22 of the contact elements 19. As stated supra, the inward extending knobs 23 are not exactly arranged in the center, but they are slightly offset in a direction towards the opening 20. The offset of the knobs 23 from a center plane in a direction towards the opening 20 of the contact elements 19 is approximately in a range between 10 and 15° in the illustrated embodiment.

The contact elements 19 are supported at the support shoulder 12 in the receiver cavity 10 of the coupling 3. A washer 25 that is arranged and fixated in the opening of the receiver cavity 10 of the coupling 3 supports the contact elements 19 in the contact section 11 of the receiver cavity 10 of the coupling 3.

The transversal supports of the plug 2 in the coupling 3 which transversal supports are formed by the support sections 4, 15 and the collars 8, 17 of the plug 2 and the coupling 3 are arranged on both sides of the contact elements 19, this means axially in front and behind the contact elements 19.

When inserting the plug 2 into the coupling 3, initially the support section 4 of the plug 2 passes through the contact elements 19, subsequently the frustum shaped spreading section 5 of the plug 2 elastically spreads or expands the contact elements 19 and subsequently the cylindrical contact section 6 of the plug 2 moves between the contact elements 19. The contact elements 19 with their inward extending knobs 23 contact the plug 2 so that the approximately semicircular arc shaped sections of the knobs are elastically pressed in outward direction between the opposite outward extending protrusions 21, 22. The approximately semicircular arcs between the opposite protrusions 21, 22 extending outward from the contact elements 19 are elastically pressed in outward direction by the plug 2 and thus elastically preloaded approximately in centers of the protrusions 21, 22, namely where the inward protruding knobs 23 are located. The knobs 23 therefore contact the contact section 6 of the plug 2 with a preload which provides an electrically well conductive connection with a low electrical resistance between the contact elements 19 and the plug 2.

Based on their offset towards the opening 20 of the contact elements 19 and based on the preload under which the inward extending knobs 23 of the contact elements 19 contact the plug 2, a radial force acts transversal to the plug 2, wherein the radial force presses the contact elements 19 into a defined position relative to the plug 2. The contact elements 19 contact the contact section 6 of the plug 2 opposite to the opening 20 of the contact elements 19.

Figure 2:
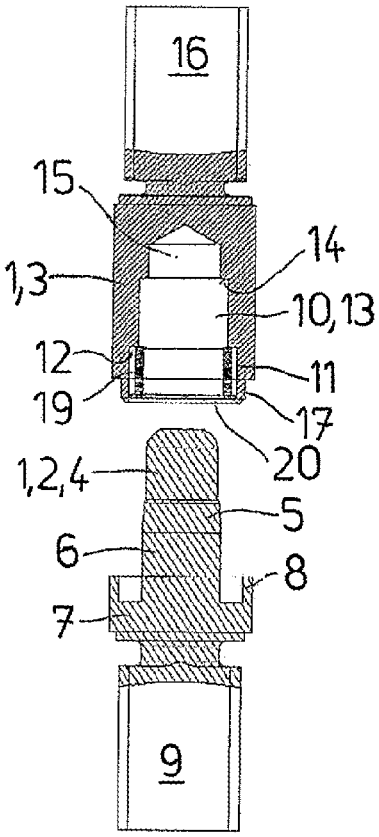
FIG. 2 illustrates a non perspective detail of the plug connector according to FIG. 2.

Opposite to the inward extending knobs 23, the contact elements 19 include two outward extending knobs 24 which are also configured as outward extending protrusions. The outward extending knobs 24 of the contact elements 19 do not contact the coupling 3. Between the knobs 24, there is a gap d, this means also when the plug 2 is inserted into the coupling 3, this means when the contact section 6 of the plug 2 is in the contact elements 19 and presses them in an elastic manner in outward direction at the inward extending knobs 23. The gap d is exaggerated in FIG. 2. It amounts to a few 1/100 mm, for example approximately 5/100 mm for a diameter of the contact section 6 of the plug 2 of 8 mm. For greater or smaller diameters, the gap d, however, does not necessarily decrease proportionally. It is not excluded either that the gap d for different diameters of the contact section 6 of the plug 2 remains constant in size. The outward extending knobs 24 define a maximum possible deformation of the contact elements 19 through a contact on an inside at the contact section 11 of the receiver cavity 10 of the coupling 3. The gap d is selected tight enough so that a plastic deformation of the contact elements 19 is excluded. The outward extending knobs 24 of the contact elements 19 also prevent a fracture or another damage to the contact elements 19 under a fatigue load, e.g. as a consequence of vibrations impacting the plug connection 1 as they occur during driving operations of a motor vehicle, in particular when the coupling 3 or the plug 2 are attached to the motor vehicle in a rigid manner without damping.

What is claimed is:

1. An electrical plug connector, comprising:

a pin-shaped plug;

a sleeve-shaped coupling which encloses the plug with an intermediary cavity in an inserted condition of the plug; and an electrically conductive contact element arranged in the intermediary cavity and configured as an interrupted ring which is spring elastic transversal to an insertion direction and which contacts the coupling and the plug in an inserted condition and which connects the plug and the coupling in an electrically conductive manner, wherein the contact element includes inward protruding knobs and outward protruding knobs, wherein the inward protruding knobs contact the plug in the inserted condition of the plug, wherein a gap is provided between the outward protruding knobs and the coupling.

2. The electrical plug connector according to claim 1, wherein the plug and the coupling have a circular cross-section in a plug-in portion and the contact element has a shape of an interrupted circular ring.

3. The electrical plug connector according to claim 1, wherein the plug connector includes plural stacked contact elements.

4. The electrical plug connector according to claim 1, wherein the plug connector includes transversal supports for the plug in the coupling on both sides of the contact element.

5. The electrical plug connector according to claim 1, wherein the inward protruding knobs are arranged offset from a center plane of the annular contact element.

6. The electrical plug connector according to claim 5, wherein the inward protruding knobs are arranged offset in a direction towards an opening from a center plane of the annular contact element.

7. The electrical plug connector according to claim 1, wherein the outward protruding knobs are arranged opposite to the inward protruding knobs.

8. The electrical plug connector according to claim 1, wherein the contact element includes two outward protruding knobs and two inward protruding knobs.

9. The electrical plug connector according to claim 1, wherein the contact element is arranged in the coupling.

* * * * *